US009767756B2

(12) United States Patent
Dai

(10) Patent No.: US 9,767,756 B2
(45) Date of Patent: Sep. 19, 2017

(54) SCANNING DRIVING CIRCUITS AND LIQUID CRYSTAL DEVICES (LCD) WITH THE SAME

(71) Applicant: Shenzhen China Star Optoelectronics Technology Co., Ltd., Shenzhen, Guangdong (CN)

(72) Inventor: Chao Dai, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 72 days.

(21) Appl. No.: 14/888,425

(22) PCT Filed: Aug. 28, 2015

(86) PCT No.: PCT/CN2015/088376
§ 371 (c)(1),
(2) Date: Oct. 31, 2015

(87) PCT Pub. No.: WO2017/028332
PCT Pub. Date: Feb. 23, 2017

(65) Prior Publication Data
US 2017/0162164 A1 Jun. 8, 2017

(51) Int. Cl.
*G09G 3/36* (2006.01)

(52) U.S. Cl.
CPC ..... *G09G 3/3685* (2013.01); *G09G 3/3648* (2013.01); *G09G 3/3674* (2013.01);
(Continued)

(58) Field of Classification Search
CPC .. G09G 3/3685; G09G 3/3648; G09G 3/3696; G09G 3/3674; G09G 2310/0272; G09G 2310/027; G11C 19/28–19/287
See application file for complete search history.

(56) References Cited

U.S. PATENT DOCUMENTS

2006/0164374 A1 7/2006 Chang et al.
2009/0096737 A1* 4/2009 Kim ..... G09G 3/3677 345/98

(Continued)

FOREIGN PATENT DOCUMENTS

CN 104700789 A 6/2015
KR 1020140079106 A 6/2014

*Primary Examiner* — Liliana Cerullo
(74) *Attorney, Agent, or Firm* — Andrew C. Cheng

(57) ABSTRACT

The present disclosure relates to a scanning driving circuit and a LCD. The scanning driving circuit includes first driving circuits and second diving circuits, each of the first driving circuits connects with each of the second diving circuits, and the first driving circuit and the second diving circuit are alternately arranged. Each of the first driving circuit and second diving circuit includes a pull-up module, a pull-up controlling module for driving the pull-up module, a reference voltage end, and a first pull-down maintaining unit. Each of the first driving circuit also includes a first pull-down maintaining controlling unit. The first and second driving circuit share the first pull-down maintaining control unit of the first driving circuit. In this way, the scanning driving circuit is stable, and the structure of the circuit is simple. The power consumption may be reduced and the border of the LCD may be narrowed down.

20 Claims, 7 Drawing Sheets

(52) U.S. Cl.
CPC ..... *G09G 3/3696* (2013.01); *G09G 2310/027* (2013.01); *G09G 2310/0272* (2013.01)

(56) References Cited

U.S. PATENT DOCUMENTS

| | | | | |
|---|---|---|---|---|
| 2010/0034032 | A1 | 2/2010 | Yang | |
| 2012/0140871 | A1* | 6/2012 | Yang | G09G 3/20 377/79 |
| 2014/0010341 | A1 | 1/2014 | Wu et al. | |
| 2015/0187312 | A1 | 7/2015 | Dai | |
| 2016/0005372 | A1 | 1/2016 | Yu | |
| 2016/0275895 | A1 | 9/2016 | Dai | |
| 2016/0307531 | A1 | 10/2016 | Xiao | |

* cited by examiner

SCANNING DRIVING CIRCUITS AND LIQUID CRYSTAL DEVICES (LCD) WITH THE SAME

BACKGROUND OF THE INVENTION

1. Field of the Invention

The present disclosure relates to liquid crystal display technology, and more particularly to a scanning driving circuit and the LCD with the same.

2. Discussion of the Related Art

Currently, LCDs adopt scanning driving circuits, which relate to manufacturing the scanning driving circuit on the array substrate via conventional TFT-LCD array manufacturing process so as to scan the rows. Regarding the scanning driving circuit, the driving circuit at each level includes the same pull-down maintaining module to maintain the turn-off state when the scanning signals are outputted so as to maintain the stability of the scanning driving circuit. However, such configuration may result in complicated circuit and huge power consumption. In addition, the border of the LCD has to be wider.

SUMMARY

The object of the invention is to provide a scanning driving circuit and a LCD with the same. In this way, the scanning driving circuit is stable, and the structure of the circuit is simple. In addition, the power consumption may be reduced and the border of the LCD may be narrowed down.

In one aspect, a scanning driving circuit includes: a plurality of first driving circuits and a plurality of second diving circuits, each of the first driving circuits connects with each of the second diving circuits, and the first driving circuit and the second diving circuit are alternately arranged; each of the first driving circuit and second diving circuit comprises a pull-up module, a pull-up controlling module for driving the pull-up module, a reference voltage end, and a first pull-down maintaining unit, each of the first driving circuit also comprises a first pull-down maintaining controlling unit; each of the first pull-down maintaining unit comprises a first controllable transistor and a second controllable transistor, the control ends of the second controllable transistor and the first controllable transistor are connected, the input end of the second controllable transistor connects with the output end of the pull-up controlling module, the output ends of the second controllable transistor and the first controllable transistor connect with the reference voltage end, the input end of the first controllable transistor connects with one scanning line; the first pull-down maintaining controlling unit comprises a third controllable transistor, a fourth controllable transistor, and a fifth controllable transistor, the input end and the control end of the third controllable transistor connect to a first pull-down maintaining signals, the control end of the fourth controllable transistor connects to the output end of the third controllable transistor, the input end of the fourth controllable transistor connects to the first pull-down maintaining signals, the output end of the fourth controllable transistor connects to the control end of the first controllable transistor, the control end of the fifth controllable transistor connects to a second pull-down maintaining signals, the input end of the fifth controllable transistor connects to the first pull-down maintaining signals, the output end of the fifth controllable transistor connects to the control end of the first controllable transistor, a logic of the first pull-down maintaining signals is opposite to that of the second pull-down maintaining signals; when the scanning lines are not within operating period, the first pull-down maintaining controlling unit of the first driving circuit connects the first controllable transistor and the second controllable transistor of the first pull-down maintaining units of the first driving circuit and the second diving circuit in accordance with the first pull-down maintaining signals and the second pull-down maintaining signals, the first controllable transistor connects the scanning line with the reference voltage end, the second controllable transistor connects the pull-up controlling module with the reference voltage end; and when the scanning lines are within the operating period, the first controllable transistor and the second controllable transistor are disconnected, the first controllable transistor and the reference voltage end are disconnected, the second controllable transistor disconnects the pull-up controlling module and the reference voltage end.

Wherein each of the first driving circuit and the second diving circuit comprises a second pull-down maintaining unit, each of the first driving circuit comprises a second pull-down maintaining controlling unit, the second pull-down maintaining unit comprises a sixth controllable transistor and a seventh controllable transistor, the control ends of the sixth controllable transistor and the seventh controllable transistor are connected, the input end of the seventh controllable transistor connects with the output end of the pull-up controlling module, the output ends of the sixth controllable transistor and the seventh controllable transistor connect with the reference voltage end, the input end of the sixth controllable transistor connects with the scanning lines; the second pull-down maintaining controlling unit comprises an eighth controllable transistor, a ninth controllable transistor, and a tenth controllable transistor, the input end and the control end of the eighth controllable transistor connects with the second pull-down maintaining signals, the control end of the ninth controllable transistor connects to the output end of the eighth controllable transistor, the input end of the ninth controllable transistor connects to the second pull-down maintaining signals, the output end of the ninth controllable transistor connects with the control end of the sixth controllable transistor, the control end of the tenth controllable transistor connects with the first pull-down maintaining signals, the input end of the tenth controllable transistor connects with the second pull-down maintaining signals, the output end of the tenth controllable transistor connects with the control end of the sixth controllable transistor; when the scanning lines are not within the operating period, the second pull-down maintaining controlling unit of the first driving circuit connects the sixth controllable transistor and the seventh controllable transistor of the second pull-down maintaining unit of the first driving circuit and the second diving circuit in accordance with the first pull-down maintaining signals and the second pull-down maintaining signals, the sixth controllable transistor connects the scanning lines with the reference voltage end, and the seventh controllable transistor connects the pull-up controlling module and the reference voltage end, when the scanning lines are within the operating period, the sixth controllable transistor and the seventh controllable transistor are disconnected, the sixth controllable transistor disconnects the scanning lines and the reference voltage end, the seventh controllable transistor disconnects the pull-up controlling module and the reference voltage end.

Wherein each of the first driving circuit and the second diving circuit comprises a balance bridge unit having an eleventh controllable transistor, the control end of the eleventh controllable transistor connects with the output end of the pull-up controlling module, the input end and the output end of the eleventh controllable transistor respectively connects to the control end of the sixth controllable transistor and the first controllable transistor, the input end of the eleventh controllable transistor of the second diving circuit connects with the input end of the eleventh controllable transistor of the first driving circuit, the output end of the eleventh controllable transistor of the second diving circuit connects with the output end of the eleventh controllable transistor of the first driving circuit.

Wherein each of the first driving circuit and the second diving circuit comprises a turn-off unit, the turn-off unit comprises the twelveth controllable transistor and a thirteenth controllable transistor, the control ends of the twelveth controllable transistor and the thirteenth controllable transistor are connected and connect to the output of the pull-up controlling module, the input end of the twelveth controllable transistor connects with the control end of the fourth controllable transistor, the output end of the twelveth controllable transistor connects with the reference voltage end, the input end of the thirteenth controllable transistor connects with the control end of the ninth controllable transistor, and the output end of the thirteenth controllable transistor connects with the reference voltage end.

Wherein the pull-up controlling module of the first driving circuit and the second diving circuit comprises a fourteenth controllable transistor, the control end of the fourteenth controllable transistor connects with the downstream signals at upper level, the input end of the fourteenth controllable transistor connects the scanning signals at upper level, the output end of the fourteenth controllable transistor is the output end of the pull-up controlling module; and the pull-up module of each of the first driving circuit and the second diving circuit comprises a fifteenth controllable transistor, the control end of the fifteenth controllable transistor connects with the output end of the fourteenth controllable transistor, the input end of the fifteenth controllable transistor connects with the first clock scanning signals, the output end of the fifteenth controllable transistor connects with the scanning lines.

Wherein each of the first driving circuit and the second diving circuit further comprises a downstream module having a sixteenth controllable transistor, the control end of the sixteenth controllable transistor connects with the output end of the pull-up controlling module, the input end of the sixteenth controllable transistor connects with the clock scanning signals, and the output end of the sixteenth controllable transistor connects with the downstream signals at upper level.

Wherein each of the first driving circuit and the second diving circuit comprises a pull-down module having a seventeenth controllable transistor and an eighteenth controllable transistor, the control ends of the seventeenth controllable transistor and the eighteenth controllable transistor are connected and connect to the scanning lines at upper level, the input end of the eighteenth controllable transistor connects with the output end of the pull-up controlling module, the output end of the seventeenth controllable transistor and the eighteenth controllable transistor connects with the reference voltage end, and the input end of the seventeenth controllable transistor connects with the scanning lines.

Wherein each of the first driving circuit and the second diving circuit comprises a storage capacitor, one end of the storage capacitor connects with the output end of the pull-up controlling module, and the other end of the storage capacitor connects to the scanning lines.

Wherein each of the first driving circuit and the second diving circuit further comprises the pull-down module, the pull-down module comprises the seventeenth controllable transistor and the eighteenth controllable transistor, the control end of the seventeenth controllable transistor connects to the scanning lines at upper level or to the downstream signals at upper level, the control end of the eighteenth controllable transistor connects to the scanning lines at upper level or to the downstream signals at upper level, the input end of the eighteenth controllable transistor connects to the output end of the pull-up controlling module, the output ends of the seventeenth controllable transistor and the eighteenth controllable transistor connect to the reference voltage end, the input end of the seventeenth controllable transistor connects to the scanning lines.

In another aspect, a liquid crystal device (LCD) includes: a scanning driving circuit comprising a plurality of first driving circuits and a plurality of second diving circuits, each of the first driving circuits connects with each of the second diving circuits, and the first driving circuit and the second diving circuit are alternately arranged; each of the first driving circuit and second diving circuit comprises a pull-up module, a pull-up controlling module for driving the pull-up module, a reference voltage end, and a first pull-down maintaining unit, each of the first driving circuit also comprises a first pull-down maintaining controlling unit; each of the first pull-down maintaining unit comprises a first controllable transistor and a second controllable transistor, the control ends of the second controllable transistor and the first controllable transistor are connected, the input end of the second controllable transistor connects with the output end of the pull-up controlling module, the output ends of the second controllable transistor and the first controllable transistor connect with the reference voltage end, the input end of the first controllable transistor connects with one scanning line; the first pull-down maintaining controlling unit comprises a third controllable transistor, a fourth controllable transistor, and a fifth controllable transistor, the input end and the control end of the third controllable transistor connect to a first pull-down maintaining signals, the control end of the fourth controllable transistor connects to the output end of the third controllable transistor, the input end of the fourth controllable transistor connects to the first pull-down maintaining signals, the output end of the fourth controllable transistor connects to the control end of the first controllable transistor, the control end of the fifth controllable transistor connects to a second pull-down maintaining signals, the input end of the fifth controllable transistor connects to the first pull-down maintaining signals, the output end of the fifth controllable transistor connects to the control end of the first controllable transistor, a logic of the first pull-down maintaining signals is opposite to that of the second pull-down maintaining signals; when the scanning lines are not within operating period, the first pull-down maintaining controlling unit of the first driving circuit connects the first controllable transistor and the second controllable transistor of the first pull-down maintaining units of the first driving circuit and the second diving circuit in accordance with the first pull-down maintaining signals and the second pull-down maintaining signals, the first controllable transistor connects the scanning line with the reference voltage end, the second controllable transistor connects the pull-up controlling module with the reference voltage end; and when the scanning lines are within the operating period, the first controllable transistor and the second controllable transistor are disconnected, the first controllable transistor and the reference voltage end are disconnected, the second controllable transistor disconnects the pull-up controlling module and the reference voltage end.

Wherein each of the first driving circuit and the second diving circuit comprises a second pull-down maintaining unit, each of the first driving circuit comprises a second pull-down maintaining controlling unit, the second pull-down maintaining unit comprises a sixth controllable transistor and a seventh controllable transistor, the control ends of the sixth controllable transistor and the seventh controllable transistor are connected, the input end of the seventh controllable transistor connects with the output end of the pull-up controlling module, the output ends of the sixth controllable transistor and the seventh controllable transistor connect with the reference voltage end, the input end of the sixth controllable transistor connects with the scanning lines; the second pull-down maintaining controlling unit comprises an eighth controllable transistor, a ninth controllable transistor, and a tenth controllable transistor, the input end and the control end of the eighth controllable transistor connects with the second pull-down maintaining signals, the control end of the ninth controllable transistor connects to the output end of the eighth controllable transistor, the input end of the ninth controllable transistor connects to the second pull-down maintaining signals, the output end of the ninth controllable transistor connects with the control end of the sixth controllable transistor, the control end of the tenth controllable transistor connects with the first pull-down maintaining signals, the input end of the tenth controllable transistor connects with the second pull-down maintaining signals, the output end of the tenth controllable transistor connects with the control end of the sixth controllable transistor;

when the scanning lines are not within the operating period, the second pull-down maintaining controlling unit of the first driving circuit connects the sixth controllable transistor and the seventh controllable transistor of the second pull-down maintaining unit of the first driving circuit and the second diving circuit in accordance with the first pull-down maintaining signals and the second pull-down maintaining signals, the sixth controllable transistor connects the scanning lines with the reference voltage end, and the seventh controllable transistor connects the pull-up controlling module and the reference voltage end, when the scanning lines are within the operating period, the sixth controllable transistor and the seventh controllable transistor are disconnected, the sixth controllable transistor disconnects the scanning lines and the reference voltage end, the seventh controllable transistor disconnects the pull-up controlling module and the reference voltage end.

Wherein each of the first driving circuit and the second diving circuit comprises a balance bridge unit having an eleventh controllable transistor, the control end of the eleventh controllable transistor connects with the output end of the pull-up controlling module, the input end and the output end of the eleventh controllable transistor respectively connects to the control end of the sixth controllable transistor and the first controllable transistor, the input end of the eleventh controllable transistor of the second diving circuit connects with the input end of the eleventh controllable transistor of the first driving circuit, the output end of the eleventh controllable transistor of the second diving circuit connects with the output end of the eleventh controllable transistor of the first driving circuit.

Wherein each of the first driving circuit and the second diving circuit comprises a turn-off unit, the turn-off unit comprises the twelveth controllable transistor and a thirteenth controllable transistor, the control ends of the twelveth controllable transistor and the thirteenth controllable transistor are connected and connect to the output of the pull-up controlling module, the input end of the twelveth controllable transistor connects with the control end of the fourth controllable transistor, the output end of the twelveth controllable transistor connects with the reference voltage end, the input end of the thirteenth controllable transistor connects with the control end of the ninth controllable transistor, and the output end of the thirteenth controllable transistor connects with the reference voltage end.

Wherein the pull-up controlling module of the first driving circuit and the second diving circuit comprises a fourteenth controllable transistor, the control end of the fourteenth controllable transistor connects with the downstream signals at upper level, the input end of the fourteenth controllable transistor connects the scanning signals at upper level, the output end of the fourteenth controllable transistor is the output end of the pull-up controlling module; and the pull-up module of each of the first driving circuit and the second diving circuit comprises a fifteenth controllable transistor, the control end of the fifteenth controllable transistor connects with the output end of the fourteenth controllable transistor, the input end of the fifteenth controllable transistor connects with the first clock scanning signals, the output end of the fifteenth controllable transistor connects with the scanning lines.

Wherein each of the first driving circuit and the second diving circuit further comprises a downstream module having a sixteenth controllable transistor, the control end of the sixteenth controllable transistor connects with the output end of the pull-up controlling module, the input end of the sixteenth controllable transistor connects with the clock scanning signals, and the output end of the sixteenth controllable transistor connects with the downstream signals at upper level.

Wherein each of the first driving circuit and the second diving circuit comprises a pull-down module having a seventeenth controllable transistor and an eighteenth controllable transistor, the control ends of the seventeenth controllable transistor and the eighteenth controllable transistor are connected and connect to the scanning lines at upper level, the input end of the eighteenth controllable transistor connects with the output end of the pull-up controlling module, the output end of the seventeenth controllable transistor and the eighteenth controllable transistor connects with the reference voltage end, and the input end of the seventeenth controllable transistor connects with the scanning lines.

Wherein each of the first driving circuit and the second diving circuit comprises a storage capacitor, one end of the storage capacitor connects with the output end of the pull-up controlling module, and the other end of the storage capacitor connects to the scanning lines.

Wherein each of the first driving circuit and the second diving circuit further comprises the pull-down module, the pull-down module comprises the seventeenth controllable transistor and the eighteenth controllable transistor, the control end of the seventeenth controllable transistor connects to the scanning lines at upper level or to the downstream signals at upper level, the control end of the eighteenth controllable transistor connects to the scanning lines at upper level or to the downstream signals at upper level, the input end of the eighteenth controllable transistor connects to the output end of the pull-up controlling module, the output ends of the seventeenth controllable transistor and the eighteenth controllable transistor connect to the reference voltage end, the input end of the seventeenth controllable transistor connects to the scanning lines.

In another aspect, a scanning driving circuit includes: a plurality of first driving circuits and a plurality of second diving circuits, each of the first driving circuits connects with each of the second diving circuits, and the first driving circuit and the second diving circuit are alternately arranged; each of the first driving circuit and second diving circuit comprises a pull-up module, a pull-up controlling module for driving the pull-up module, a reference voltage end, and a first pull-down maintaining unit, each of the first driving circuit also comprises a first pull-down maintaining controlling unit; wherein the pull-up controlling module comprises a fourteenth controllable transistor, the control end of the fourteenth controllable transistor connects with the downstream signals at upper level, the input end of the fourteenth controllable transistor connects the scanning signals at upper level, the output end of the fourteenth controllable transistor is the output end of the pull-up controlling module; the pull-up module comprises a fifteenth controllable transistor, the control end of the fifteenth controllable transistor connects with the output end of the fourteenth controllable transistor, the input end of the fifteenth controllable transistor connects with the first clock scanning signals, the output end of the fifteenth controllable transistor connects with the scanning lines; each of the first driving circuit and the second diving circuit comprises a storage capacitor, one end of the storage capacitor connects with the output end of the pull-up controlling module, and the other end of the storage capacitor connects to the scanning lines; each of the first pull-down maintaining unit comprises a first controllable transistor and a second controllable transistor, the control ends of the second controllable transistor and the first controllable transistor are connected, the input end of the second controllable transistor connects with the output end of the pull-up controlling module, the output ends of the second controllable transistor and the first controllable transistor connect with the reference voltage end, the input end of the first controllable transistor connects with one scanning line; the first pull-down maintaining controlling unit comprises a third controllable transistor, a fourth controllable transistor, and a fifth controllable transistor, the input end and the control end of the third controllable transistor connect to a first pull-down maintaining signals, the control end of the fourth controllable transistor connects to the output end of the third controllable transistor, the input end of the fourth controllable transistor connects to the first pull-down maintaining signals, the output end of the fourth controllable transistor connects to the control end of the first controllable transistor, the control end of the fifth controllable transistor connects to a second pull-down maintaining signals, the input end of the fifth controllable transistor connects to the first pull-down maintaining signals, the output end of the fifth controllable transistor connects to the control end of the first controllable transistor, a logic of the first pull-down maintaining signals is opposite to that of the second pull-down maintaining signals; when the scanning lines are not within operating period, the first pull-down maintaining controlling unit of the first driving circuit connects the first controllable transistor and the second controllable transistor of the first pull-down maintaining units of the first driving circuit and the second diving circuit in accordance with the first pull-down maintaining signals and the second pull-down maintaining signals, the first controllable transistor connects the scanning line with the reference voltage end, the second controllable transistor connects the pull-up controlling module with the reference voltage end; and when the scanning lines are within the operating period, the first controllable transistor and the second controllable transistor are disconnected, the first controllable transistor and the reference voltage end are disconnected, the second controllable transistor disconnects the pull-up controlling module and the reference voltage end.

Wherein each of the first driving circuit and the second diving circuit comprises a second pull-down maintaining unit, each of the first driving circuit comprises a second pull-down maintaining controlling unit, the second pull-down maintaining unit comprises a sixth controllable transistor and a seventh controllable transistor, the control ends of the sixth controllable transistor and the seventh controllable transistor are connected, the input end of the seventh controllable transistor connects with the output end of the pull-up controlling module, the output ends of the sixth controllable transistor and the seventh controllable transistor connect with the reference voltage end, the input end of the sixth controllable transistor connects with the scanning lines; the second pull-down maintaining controlling unit comprises an eighth controllable transistor, a ninth controllable transistor, and a tenth controllable transistor, the input end and the control end of the eighth controllable transistor connects with the second pull-down maintaining signals, the control end of the ninth controllable transistor connects to the output end of the eighth controllable transistor, the input end of the ninth controllable transistor connects to the second pull-down maintaining signals, the output end of the ninth controllable transistor connects with the control end of the sixth controllable transistor, the control end of the tenth controllable transistor connects with the first pull-down maintaining signals, the input end of the tenth controllable transistor connects with the second pull-down maintaining signals, the output end of the tenth controllable transistor connects with the control end of the sixth controllable transistor; when the scanning lines are not within the operating period, the second pull-down maintaining controlling unit of the first driving circuit connects the sixth controllable transistor and the seventh controllable transistor of the second pull-down maintaining unit of the first driving circuit and the second diving circuit in accordance with the first pull-down maintaining signals and the second pull-down maintaining signals, the sixth controllable transistor connects the scanning lines with the reference voltage end, and the seventh controllable transistor connects the pull-up controlling module and the reference voltage end, when the scanning lines are within the operating period, the sixth controllable transistor and the seventh controllable transistor are disconnected, the sixth controllable transistor disconnects the scanning lines and the reference voltage end, the seventh controllable transistor disconnects the pull-up controlling module and the reference voltage end.

In view of the above, the LCD includes alternately arranged first driving circuit and the second driving circuit. The first driving circuit not only includes the same components with the second driving circuit, but also includes the first and the second pull-down maintaining control unit. In this way, the scanning driving circuit is stable, and the structure of the circuit is simple. In addition, the power consumption may be reduced and the border of the LCD may be narrowed down.

DETAILED DESCRIPTION OF THE EMBODIMENTS

Embodiments of the invention will now be described more fully hereinafter with reference to the accompanying drawings, in which embodiments of the invention are shown.

Figure 1:
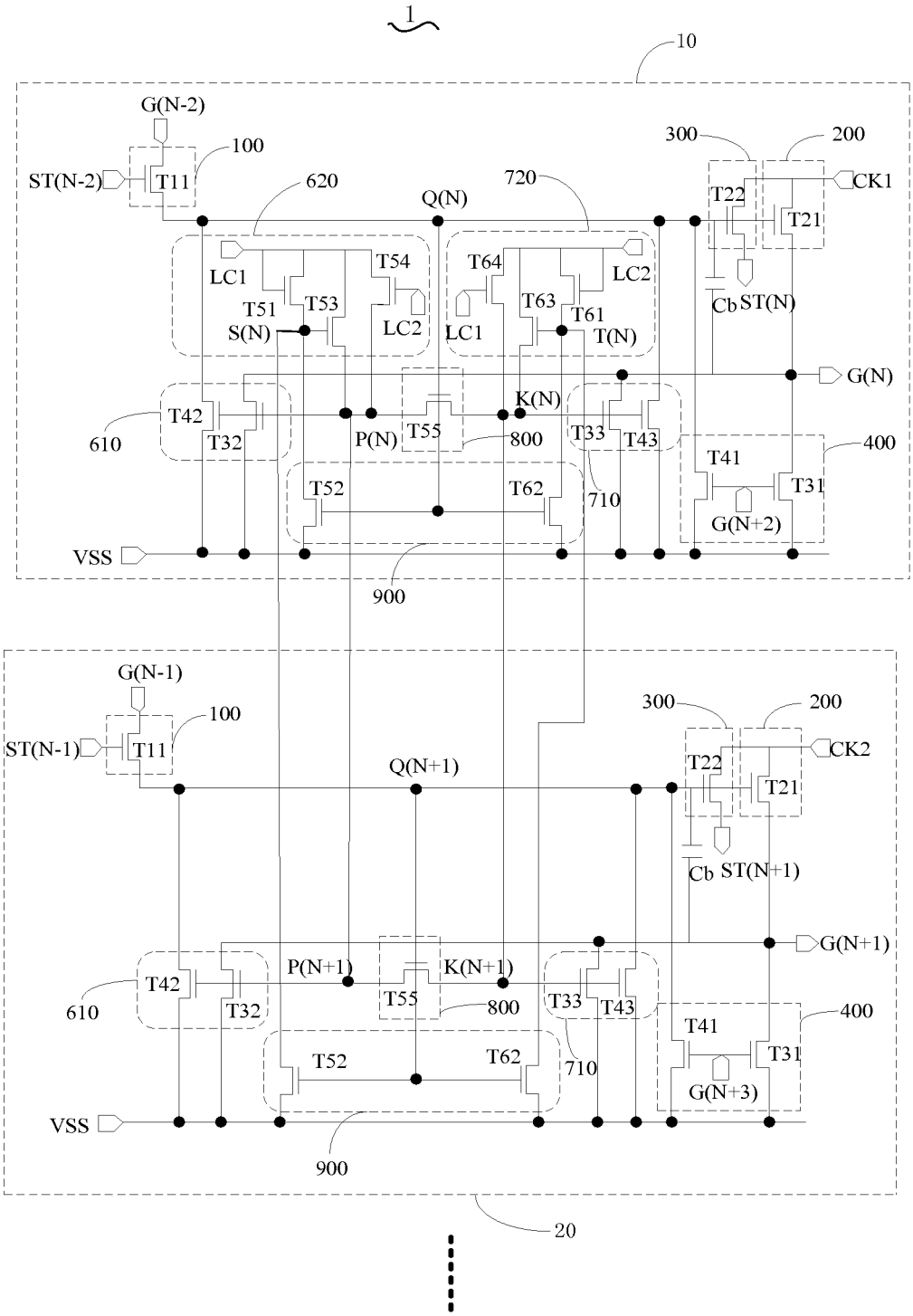
FIG. 1 is a schematic view of the scanning driving circuit in accordance with a first embodiment.
Figure 2:
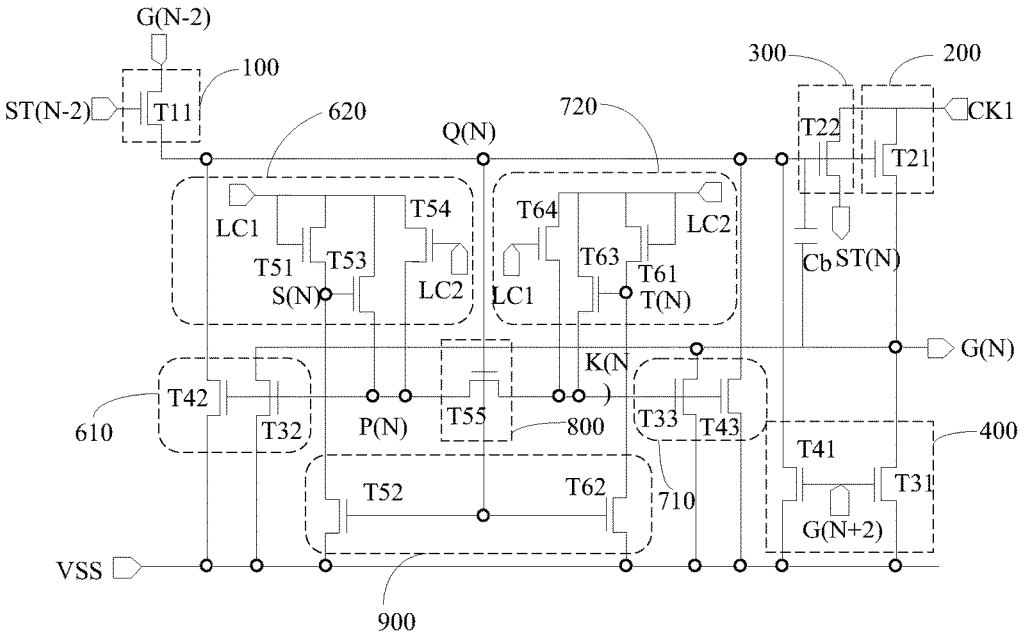
FIG. 2 is a schematic view of the first driving circuit of the scanning driving circuit in accordance with the first embodiment.
Figure 3:
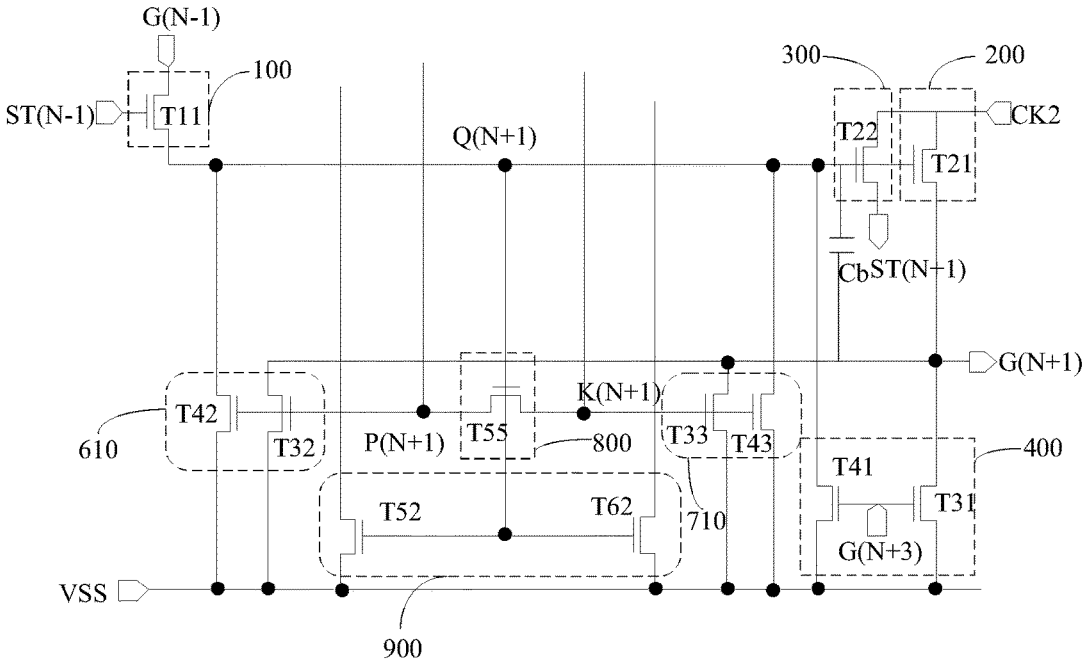
FIG. 3 is a schematic view of the second driving circuit of the scanning driving circuit in accordance with the first embodiment.

FIGS. 1-3 are schematic views of the scanning driving circuit in accordance with a first embodiment. The scanning driving circuit 1 includes a plurality of first driving circuits 10 and a plurality of second diving circuits 20. Each of the first driving circuits 10 connects with each of the second diving circuits 20, and the first driving circuit 10 and the second diving circuit 20 are alternately arranged.

Each of the first driving circuit 10 and second diving circuit 20 includes a pull-up module 200, a pull-up controlling module 100 for driving the pull-up module 200, a reference voltage end (VSS), and a first pull-down maintaining unit 610. Each of the first driving circuit 10 also includes a first pull-down maintaining controlling unit 620. Each of the first pull-down maintaining unit 610 includes a first controllable transistor (T32) and a second controllable transistor (T42). The control ends of the second controllable transistor (T42) and the first controllable transistor (T32) are connected, the input end of the second controllable transistor (T42) connects with the output end of the pull-up controlling module 100, the output ends of the second controllable transistor (T42) and the first controllable transistor (T32) connect with the reference voltage end (VSS), the input end of the first controllable transistor (T32) connects with one scanning line, i.e., G(N) and G(N+1).

The first pull-down maintaining controlling unit 620 includes a third controllable transistor (T51), a fourth controllable transistor (T53), and a fifth controllable transistor (T54). The input end and the control end of the third controllable transistor (T51) connect to a first pull-down maintaining signals (LC1). The control end of the fourth controllable transistor (T53) connects to the output end of the third controllable transistor (T51), the input end of the fourth controllable transistor (T53) connects to the first pull-down maintaining signals (LC1), the output end of the fourth controllable transistor (T53) connects to the control end of the first controllable transistor (T32), the control end of the fifth controllable transistor (T54) connects to a second pull-down maintaining signals (LC2), the input end of the fifth controllable transistor (T54) connects to the first pull-down maintaining signals (LC1), the output end of the fifth controllable transistor (T54) connects to the control end of the first controllable transistor (T32). The logic of the first pull-down maintaining signals (LC1) is opposite to that of the second pull-down maintaining signals (LC2).

When the scanning line G(N) and G(N+1) are not within operating period, the first pull-down maintaining controlling unit 620 of the first driving circuit 10 connects the first controllable transistor (T32) and the second controllable transistor (T42) of the first pull-down maintaining units 610 of the first driving circuit 10 and the second diving circuit 20 in accordance with the first pull-down maintaining signals (LC1) and the second pull-down maintaining signals (LC2). The first controllable transistor (T32) connects the scanning line G(N) and G(N+1) with the reference voltage end (VSS). The second controllable transistor (T42) connects the pull-up controlling module 100 with the reference voltage end (VSS).

When the scanning line G(N) and G(N+1) are within the operating period, the first controllable transistor (T32) and the second controllable transistor (T42) are disconnected. The first controllable transistor (T32) and the reference voltage end (VSS) are disconnected. The second controllable transistor (T42) disconnects the pull-up controlling module 100 and the reference voltage end (VSS).

Each of the first driving circuit 10 and the second diving circuit 20 includes a second pull-down maintaining unit 710. Each of the first driving circuit 10 includes a second pull-down maintaining controlling unit 720. The second pull-down maintaining unit 710 includes a sixth controllable transistor (T33) and a seventh controllable transistor (T43). The control ends of the sixth controllable transistor (T33) and the seventh controllable transistor (T43) are connected, the input end of the seventh controllable transistor (T43) connects with the output end of the pull-up controlling module 100, the output ends of the sixth controllable transistor (T33) and the seventh controllable transistor (T43) connect with the reference voltage end (VSS), the input end of the sixth controllable transistor (T33) connects with the scanning line G(N) and G(N+1).

The second pull-down maintaining controlling unit 720 includes an eighth controllable transistor (T61), a ninth controllable transistor (T63), and a tenth controllable transistor (T64). The input end and control end of the eighth controllable transistor (T61) connects with the second pull-down maintaining signals (LC2), the control end of the ninth controllable transistor (T63) connects to the output end of the eighth controllable transistor (T61), the input end of the ninth controllable transistor (T63) connects to the second pull-down maintaining signals (LC2), the output end of the ninth controllable transistor (T63) connects with the control end of the sixth controllable transistor (T33), the control end of the tenth controllable transistor (T64) connects with the first pull-down maintaining signals (LC1), the input end of the tenth controllable transistor (T64) connects with the second pull-down maintaining signals (LC2), the output end of the tenth controllable transistor (T64) connects with the control end of the sixth controllable transistor (T33).

When the scanning line G(N) and G(N+1) are not within the operating period, the second pull-down maintaining controlling unit 720 of the first driving circuit 10 connects the sixth controllable transistor (T33) and the seventh controllable transistor (T43) of the second pull-down maintaining unit 710 of the first driving circuit 10 and the second diving circuit 20 in accordance with the first pull-down maintaining signals (LC1) and the second pull-down maintaining signals (LC2). The sixth controllable transistor (T33)

connects the scanning line G(N) and G(N+1) with the reference voltage end (VSS), and the seventh controllable transistor (T43) connects the pull-up controlling module 100 and the reference voltage end (VSS).

When the scanning line G(N) and G(N+1) are within the operating period, the sixth controllable transistor (T33) and the seventh controllable transistor (T43) are disconnected, the sixth controllable transistor (T33) disconnects the scanning line G(N) and G(N+1) and the reference voltage end (VSS), the seventh controllable transistor (T43) disconnects the pull-up controlling module 100 and the reference voltage end (VSS).

When the scanning line G(N) and G(N+1) are not within the operating period, the first pull-down maintaining unit 610 and the second pull-down maintaining unit 710 are alternately turned on. When the first pull-down maintaining unit 610 is turned on, the first controllable transistor (T32) and the seventh controllable transistor (T43) are connected. When the second pull-down maintaining unit 710 is turned on, the sixth controllable transistor (T33) and the seventh controllable transistor (T43) are connected. When the scanning line G(N) and G(N+1) are within the operating period, the first pull-down maintaining unit 610 and the second pull-down maintaining unit 710 are turned off, and the first controllable transistor (T32), the second controllable transistor (T42), the sixth controllable transistor (T33) and the seventh controllable transistor (T43) are turned off.

In the embodiment, two sets of pull-down maintaining modules are configured, such as the first pull-down maintaining unit 610 and the first pull-down maintaining controlling unit 620, and the second pull-down maintaining unit 710 and the second pull-down maintaining controlling unit 720. The two sets of pull-down maintaining modules may be switched alternately such that one set may be in a negative voltage recovery state for half time period, wherein the level of the transistor, regardless of the turn-on state or turn-off state, may change. This may result in that the pull-down maintaining module cannot be turned on smoothly, and may not be turned off smoothly.

Each of the first driving circuit 10 and the second diving circuit 20 includes a balance bridge unit 800 having an eleventh controllable transistor (T55). The control end of the eleventh controllable transistor (T55) connects with the output end of the pull-up controlling module 100, the input end and the output end of the eleventh controllable transistor (T55) respectively connects to the control end of the sixth controllable transistor (T33) and the first controllable transistor (T32), the input end of the eleventh controllable transistor (T55) of the second diving circuit 20 connects with the input end of the eleventh controllable transistor (T55) of the first driving circuit 10, the output end of the eleventh controllable transistor (T55) of the second diving circuit 20 connects with the output end of the eleventh controllable transistor (T55) of the first driving circuit 10.

When the scanning line G(N) and G(N+1) are within the operating period, the eleventh controllable transistor (T55) is turned on so as to connect the control ends of the first pull-down maintaining unit 610 and the second pull-down maintaining unit 710, the control ends of the first pull-down maintaining unit 610 and the second pull-down maintaining unit 710 are at one end at the low level for pulling down the other end at the high level. As such, the first pull-down maintaining unit 610 and the second pull-down maintaining unit 710 are disconnected. The configured eleventh controllable transistor (T55) balances the level at two ends. Within the operating period, particularly when the twelveth controllable transistor (T52) is invalid. The level of the P(N) and P(N+1) may be pulled down to the level of K(N) and K(N+1) via the eleventh controllable transistor (T55) to turn off the first controllable transistor (T32), the second controllable transistor (T42), the sixth controllable transistor (T33) and the seventh controllable transistor (T43). This prevents the TFTs from not being disconnected completely such that the signals of the output end of the pull-up controlling module 100 and the scanning line G(N) and G(N+1) are not affected, that is, the output of the scanning driving circuit 1 is prevented from being affected.

Each of the first driving circuit 10 and the second diving circuit 20 includes a turn-off unit 900. The turn-off unit 900 includes the twelveth controllable transistor (T52) and a thirteenth controllable transistor (T62). The control ends of the twelveth controllable transistor (T52) and the thirteenth controllable transistor (T62) are connected and connect to the output of the pull-up controlling module 100. The input end of the twelveth controllable transistor (T52) connects with the control end of the fourth controllable transistor (T53), the output end of the twelveth controllable transistor (T52) connects with the reference voltage end (VSS), the input end of the thirteenth controllable transistor (T62) connects with the control end of the ninth controllable transistor (T63), and the output end of the thirteenth controllable transistor (T62) connects with the reference voltage end (VSS).

Within the operating period, the twelveth controllable transistor (T52) and the thirteenth controllable transistor (T62) pull down the level of the control end S(N) and S(N+1) of the fourth controllable transistor (T53) and the level of the control end T(N) and T(N+1) of the ninth controllable transistor (T63). This may contributes to pulling down the level at the control end P(N) and P(N+1) of the first controllable transistor (T32) and the second controllable transistor (T42) and the control end K(N) and K(N+1) of the sixth controllable transistor (T33) and the seventh controllable transistor (T43) so as to disconnect the pull-down maintaining module. As such, the scanning driving circuit 1 is prevented from being affected by the pull-down effects of the pull-down maintaining module. As the low level of the first pull-down maintaining signals (LC1) is lower than the signals of the reference voltage end (VSS), the level difference (Vgs) between the control end and the output end of the first controllable transistor (T32), the second controllable transistor (T42), the sixth controllable transistor (T33), and the seventh controllable transistor (T43) is smaller than zero i.e., Vgs<0. That is, the TFTs are in the negative state so as to ensure the stability of the circuit.

The first pull-down maintaining signals (LC1) and the shorting bar (L2) are not only the low level smaller than the reference voltage end (VSS), and are also the low frequency signals. The first pull-down maintaining signals (LC1) and the second pull-down maintaining signals (LC2) are switched between a blank time period between the frames.

The pull-up controlling module 100 of the first driving circuit 10 and the second diving circuit 20 include a fourteenth controllable transistor (T11). The control end of the fourteenth controllable transistor (T11) connects with the downstream signals at upper level ST(N−2) and ST(N−1). The input end of the fourteenth controllable transistor (T11) connects the scanning signals at upper level G(N−2) and G(N−1). The output end of the fourteenth controllable transistor (T11) may be the output end of the pull-up controlling module 100.

The pull-up module 200 of each of the first driving circuit 10 and the second diving circuit 20 include a fifteenth controllable transistor (T21). The control end of the fifteenth controllable transistor (T21) connects with the output end of the fourteenth controllable transistor (T11). The input end of the fifteenth controllable transistor (T21) connects with the clock scanning signals (CK1, CK2). The output end of the fifteenth controllable transistor (T21) connects with the scanning line G(N) and G(N+1).

Each of the first driving circuit 10 and the second diving circuit 20 further includes a downstream module 300 having a sixteenth controllable transistor (T22). The control end of the sixteenth controllable transistor (T22) connects with the output end of the pull-up controlling module 100, the input end of the sixteenth controllable transistor (T22) connects with the clock scanning signals (CK1, CK2), the output end of the sixteenth controllable transistor (T22) connects with the downstream signals ST(N) and SN (N+1) at upper level. The sixteenth controllable transistor (T22) transmits signals to the control end of the fifteenth controllable transistor (T21) so as to provide a buffering function to reduce the effect toward the signals delay.

Each of the first driving circuit 10 and the second diving circuit 20 includes a pull-down module 400 having a seventeenth controllable transistor (T31) and an eighteenth controllable transistor (T41). The control ends of the seventeenth controllable transistor (T31) and the eighteenth controllable transistor (T41) are connected and connect to the scanning line G(N+2) and G(N+3) at upper level. The input end of the eighteenth controllable transistor (T41) connects with the output end of the pull-up controlling module 100, the output end of the seventeenth controllable transistor (T31) and the eighteenth controllable transistor (T41) connects with the reference voltage end (VSS), the input end of the seventeenth controllable transistor (T31) connects with the scanning line G(N) and G(N+1). The seventeenth controllable transistor (T31) is configured for pulling down the level of the scanning line G(N) and G(N+1) to the reference voltage end (VSS) to ensure the level of the scanning line G(N) and G(N+1) is maintained at low level. The eighteenth controllable transistor (T41) is configured for pulling down the level of the pull-down nodes Q(N) and Q(N+1) to the reference voltage end (VSS) to ensure the fifteenth controllable transistor (T21) and the sixteenth controllable transistor (T22) may be normally turned off.

Each of the first driving circuit 10 and the second diving circuit 20 includes a storage capacitor (Cb). One end of the storage capacitor (Cb) connects with the output end of the pull-up controlling module 100, and the other end of the storage capacitor (Cb) connects to the scanning line G(N) and G(N+1). The storage capacitor (Cb) is configured for pulling up the level of the pull-down nodes Q(N) and Q(N+1) basing on the conservation of charge principle so as to ensure the fifteenth controllable transistor (T21) owns enough driving capability.

Figure 4:
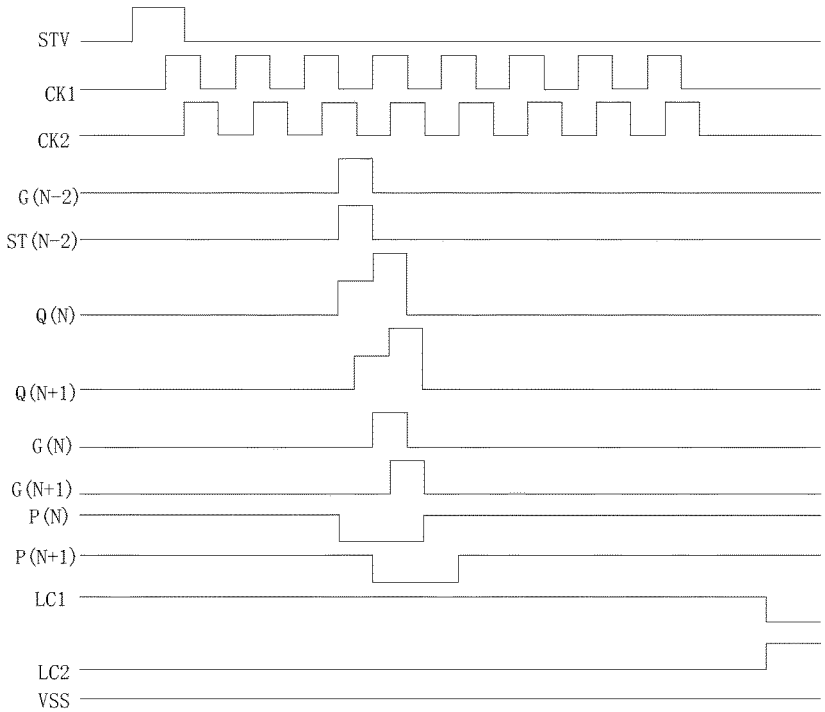
FIG. 4 is a waveform diagram of the scanning driving circuit in accordance with the second embodiment.

FIG. 4 is a waveform diagram of the scanning driving circuit in accordance with the second embodiment. In the embodiment, the first pull-down maintaining signals (LC1) and the second pull-down maintaining signals (LC2) are low frequency signals, which not only can prevent the signals of the scanning driving circuit from being affected due to the level change occurring during the switch between the high level and the low level, but also can adapt to the structure of the pull-down maintaining module such that there is no limitation regarding the pulse period of the first pull-down maintaining signals (LC1) and the second pull-down maintaining signals (LC2). The only requirement is that the level of the first pull-down maintaining signals (LC1) and the second pull-down maintaining signals (LC2) have to be compensated by each other. Preferably, the first pull-down maintaining signals (LC1) and the second pull-down maintaining signals (LC2) are switched between a blank time period between the frames. In this way, the waveforms of the pull-down maintaining signals and the pull-up control signals may be matched with each other, and thus the scanning driving circuit is prevented from malfunction or invalid. This enhances the stability of the scanning driving circuit.

As shown in FIG. 4, the liquid crystal is responsible for controlling the high and low level of the pull-down maintaining circuit, such as P(N) and K(N). Within the operating period, the level of the pull-down maintaining circuit is pulled to be the low level of the first pull-down maintaining signals (LC1) and the second pull-down maintaining signals (LC2). That is, within the operating period, the level of the control end of the TFTs for pull-down maintain, including the first controllable transistor (T32) and the second controllable transistor (T42), is lower than the turn-off state of the reference voltage end (VSS) to ensure the operations of the scanning driving circuit. The reference voltage end (VSS) is configured for providing the low level of the output signals outputted from the output end of the scanning signals and for pulling down the level of the pull-down nodes Q(N), S(N), and T(N) so as to efficiently resolve the images having clock through effects of the TFTs within the pixel display area.

The STV may be turn-on signals of the scanning driving circuit. The STV is configured for turning on the first or the second driving circuit, and is configured for pulling down Q nodes at the last node or at the last two nodes. The output, input, upstream and downstream signals are controlled by the operations of the scanning driving circuit.

Figure 5:
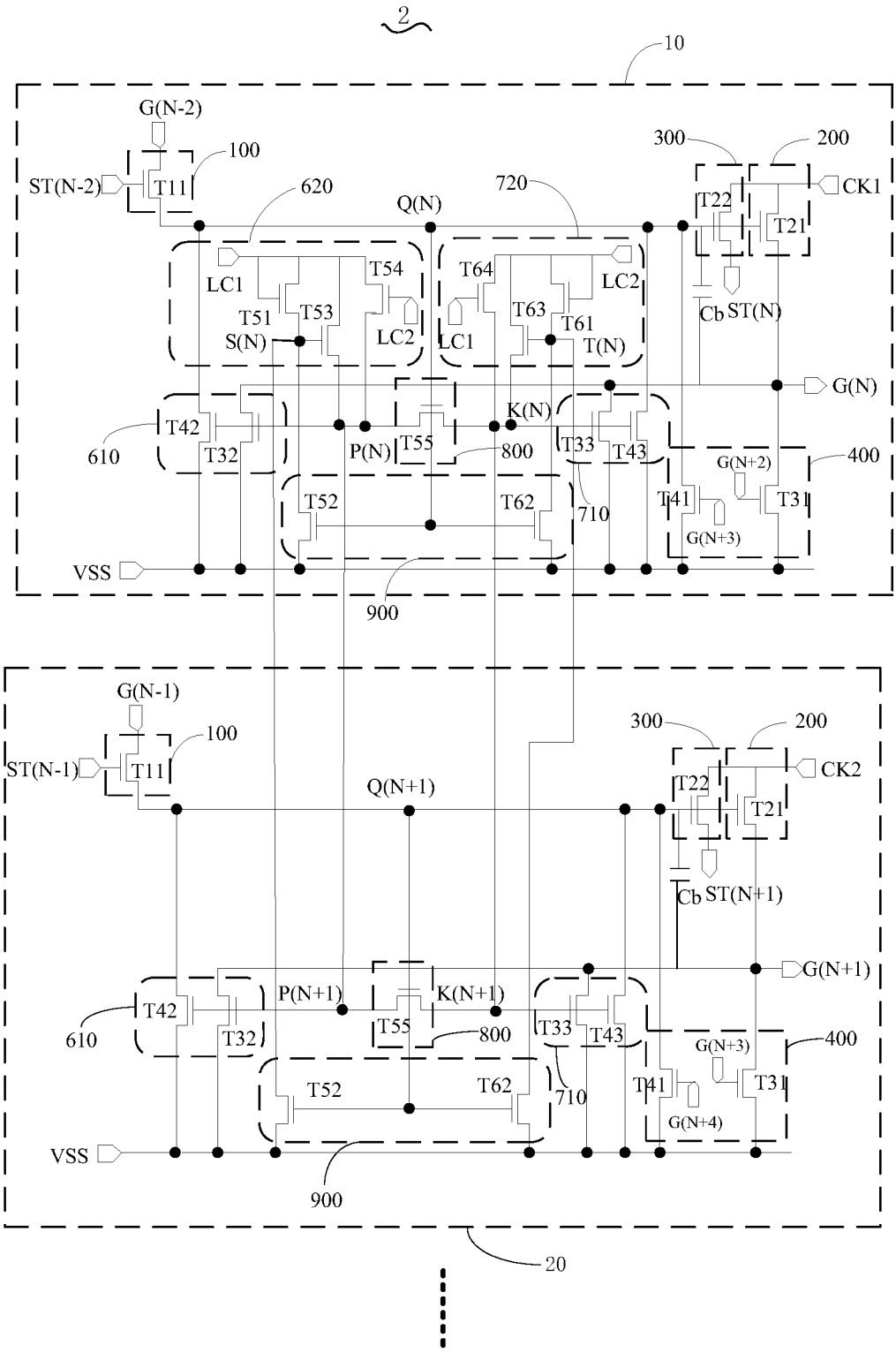
FIG. 5 is a schematic view of the scanning driving circuit in accordance with the second embodiment.
Figure 6:
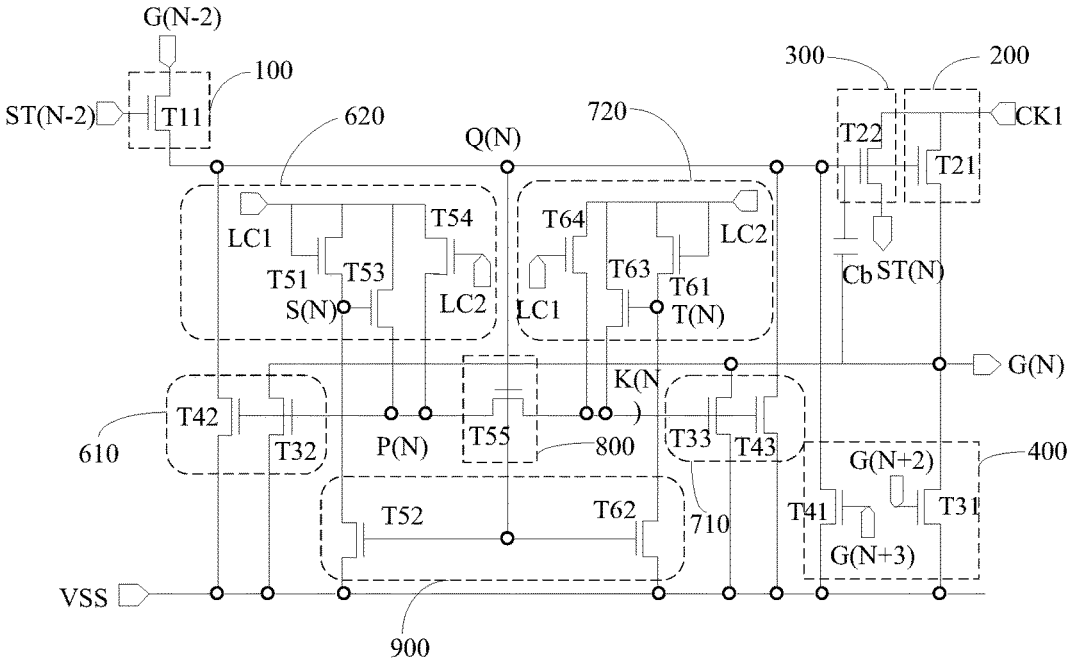
FIG. 6 is a schematic view of the first driving circuit of the scanning driving circuit in accordance with the second embodiment.
Figure 7:
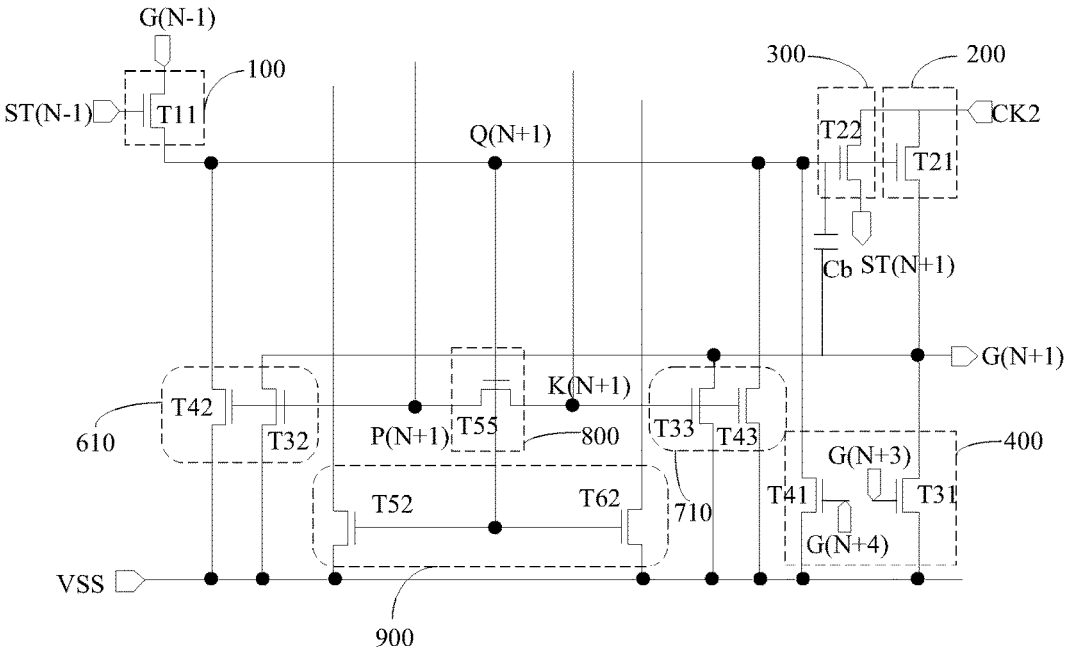
FIG. 7 is a schematic view of the second driving circuit of the scanning driving circuit in accordance with the second embodiment.

FIGS. 5-7 are schematic views of the scanning driving circuit 2 in accordance with the second embodiment. The difference between the scanning driving circuit 1 and the scanning driving circuit 2 resides in that the each of the first driving circuit 10 and the second diving circuit 20 further include the pull-down module 400. The pull-down module 400 includes the seventeenth controllable transistor (T31) and the eighteenth controllable transistor (T41). The control end of the seventeenth controllable transistor (T31) connects to the scanning line G(N+2) at upper level or to the downstream signals at upper level. The control end of the eighteenth controllable transistor (T41) connects to the scanning line G(N+3) at upper level or to the downstream signals at upper level. The input end of the eighteenth controllable transistor (T41) connects to the output end of the pull-up controlling module 100. The output ends of the seventeenth controllable transistor (T31) and the eighteenth controllable transistor (T41) connect to the reference voltage end (VSS). The input end of the seventeenth controllable transistor (T31) connects to the scanning line G(N) and G(N+1).

Figure 8:
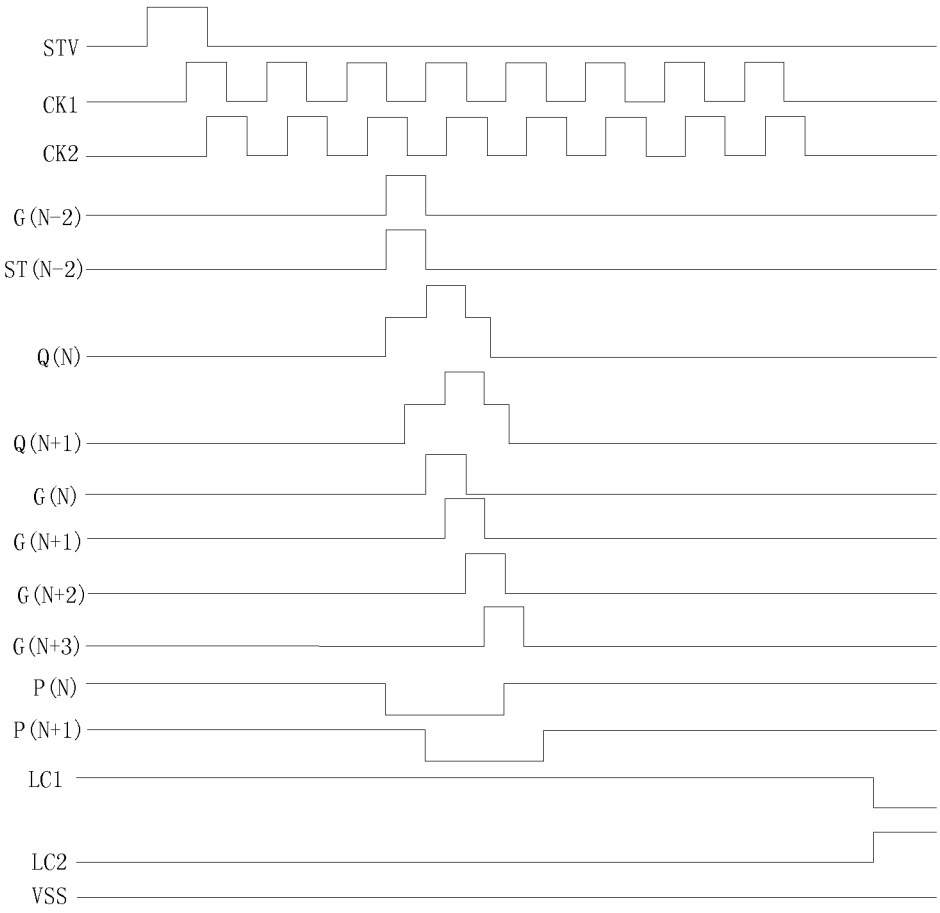
FIG. 8 is a waveform diagram of the scanning driving circuit in accordance with the second embodiment.

FIG. 8 is a waveform diagram of the scanning driving circuit in accordance with the second embodiment. In the embodiment, the control end of the eighteenth controllable transistor (T41) of the pull-down module 400 of the first driving circuit 10 connects to the signal line at the next level, i.e., G(N+3). The control end of the seventeenth controllable transistor (T31) connects to the signal lines at the next level, i.e., G(N+2). The control end of the eighteenth controllable transistor (T41) of the pull-down module 400 of the second diving circuit 20 connects to the signal line at the next level, i.e., G(N+4). At the same time, the control end of the seventeenth controllable transistor (T31) connects to the signal line at the next level, i.e., G(N+3). In this way, the signals of the Q(N) and Q(N+1) are shown as "凸" so as to enhance the pull-down capability of the scanning line G(N) and G(N+1).

In the embodiment, the pull-down maintaining module may be only arranged at one side. For instance, only the first pull-down maintaining unit 610 and the first pull-down maintaining controlling unit 620 is configured, or only the second pull-down maintaining unit 710 and the second pull-down maintaining controlling unit 720 is configured. This also can achieves the same effects as discussed above.

Figure 9:
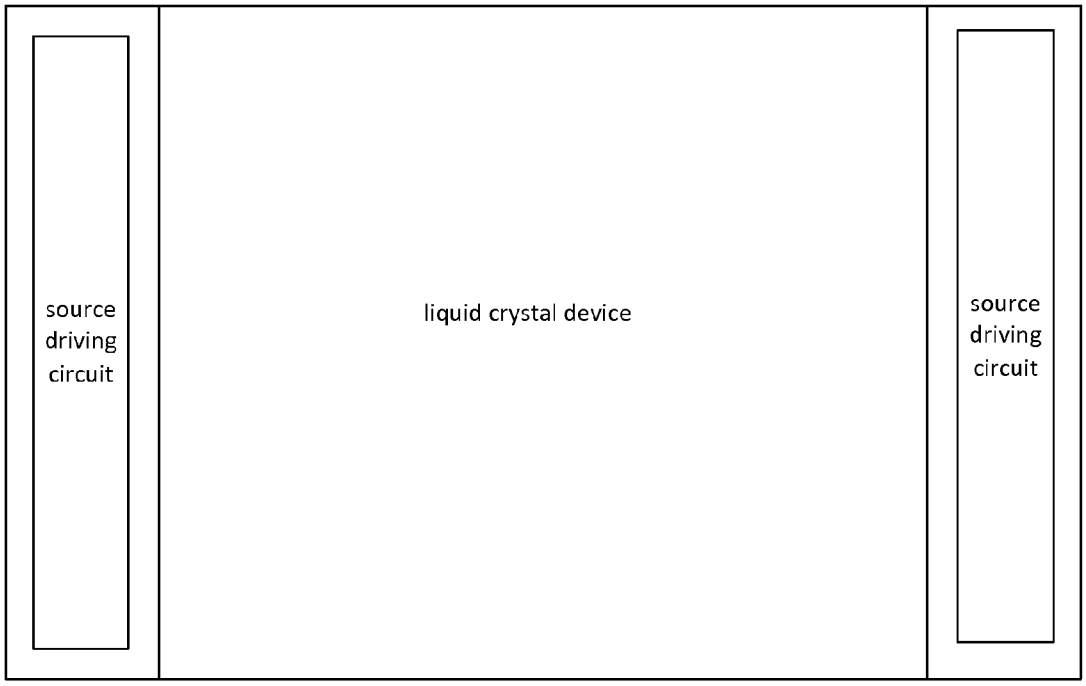
FIG. 9 is a schematic view of the LCD in accordance with one embodiment.

FIG. 9 is a schematic view of the LCD in accordance with one embodiment. The LCD includes the scanning driving circuit 1 or the scanning driving circuit 2 arranged at two sides of the LCD. The scanning driving circuit 1 or the scanning driving circuit 2 may be the any one of the above scanning driving circuit.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A scanning driving circuit, comprising:

a plurality of first driving circuits and a plurality of second diving circuits, each of the first driving circuits connects with each of the second diving circuits, and the first driving circuit and the second diving circuit are alternately arranged and are connected to scanning lines;

each of the first driving circuit and second diving circuit comprises a pull-up module, a pull-up controlling module for driving the pull-up module, a reference voltage end, and a first pull-down maintaining unit, each of the first driving circuit also comprises a first pull-down maintaining controlling unit;

each of the first pull-down maintaining unit comprises a first controllable transistor and a second controllable transistor, control ends of the second controllable transistor and the first controllable transistor are connected, an input end of the second controllable transistor connects with an output end of the pull-up controlling module, output ends of the second controllable transistor and the first controllable transistor connect with the reference voltage end, an input end of the first controllable transistor connects with one scanning line;

the first pull-down maintaining controlling unit comprises a third controllable transistor, a fourth controllable transistor, and a fifth controllable transistor, an input end and a control end of the third controllable transistor connect to a first pull-down maintaining signals, a control end of the fourth controllable transistor connects to an output end of the third controllable transistor, an input end of the fourth controllable transistor connects to the first pull-down maintaining signals, an output end of the fourth controllable transistor connects to the control end of the first controllable transistor, a control end of the fifth controllable transistor connects to a second pull-down maintaining signals, an input end of the fifth controllable transistor connects to the first pull-down maintaining signals, an output end of the fifth controllable transistor connects to the control end of the first controllable transistor, a logic of the first pull-down maintaining signals is opposite to that of the second pull-down maintaining signals;

when the scanning lines are not within an operating period, the first pull-down maintaining controlling unit of the first driving circuit connects the first controllable transistor and the second controllable transistor of the first pull-down maintaining units of the first driving circuit and the second diving circuit in accordance with the first pull-down maintaining signals and the second pull-down maintaining signals, the first controllable transistor connects the scanning line with the reference voltage end, the second controllable transistor connects the pull-up controlling module with the reference voltage end; and when the scanning lines are within the operating period, the first controllable transistor and the second controllable transistor are disconnected, the first controllable transistor and the reference voltage end are disconnected, the second controllable transistor disconnects the pull-up controlling module and the reference voltage end.

2. The scanning driving circuit as claimed in claim 1, wherein each of the first driving circuit and the second diving circuit comprises a second pull-down maintaining unit, each of the first driving circuit comprises a second pull-down maintaining controlling unit, the second pull-down maintaining unit comprises a sixth controllable transistor and a seventh controllable transistor, control ends of the sixth controllable transistor and the seventh controllable transistor are connected, an input end of the seventh controllable transistor connects with the output end of the pull-up controlling module, output ends of the sixth controllable transistor and the seventh controllable transistor connect with the reference voltage end, an input end of the sixth controllable transistor connects with the scanning lines;

the second pull-down maintaining controlling unit comprises an eighth controllable transistor, a ninth controllable transistor, and a tenth controllable transistor, an input end and a control end of the eighth controllable transistor connects with the second pull-down maintaining signals, a control end of the ninth controllable transistor connects to an output end of the eighth controllable transistor, an input end of the ninth controllable transistor connects to the second pull-down maintaining signals, an output end of the ninth controllable transistor connects with the control end of the sixth controllable transistor, a control end of the tenth controllable transistor connects with the first pull-down maintaining signals, an input end of the tenth controllable transistor connects with the second pull-down maintaining signals, an output end of the tenth controllable transistor connects with the control end of the sixth controllable transistor;

when the scanning lines are not within the operating period, the second pull-down maintaining controlling unit of the first driving circuit connects the sixth controllable transistor and the seventh controllable transistor of the second pull-down maintaining unit of the first driving circuit and the second diving circuit in accordance with the first pull-down maintaining signals and the second pull-down maintaining signals, the sixth controllable transistor connects the scanning lines with the reference voltage end, and the seventh controllable transistor connects the pull-up controlling module and the reference voltage end, when the scanning lines are within the operating period, the sixth controllable transistor and the seventh controllable transistor are disconnected, the sixth controllable transistor disconnects the scanning lines and the reference voltage end, the seventh controllable transistor disconnects the pull-up controlling module and the reference voltage end.

3. The scanning driving circuit as claimed in claim 2, wherein each of the first driving circuit and the second diving circuit comprises a balance bridge unit having an eleventh controllable transistor, a control end of the eleventh controllable transistor connects with the output end of the pull-up controlling module, an input end and an output end of the eleventh controllable transistor respectively connects to control ends of the sixth controllable transistor and the first controllable transistor, the input end of the eleventh controllable transistor of the second diving circuit connects with the input end of the eleventh controllable transistor of the first driving circuit, the output end of the eleventh controllable transistor of the second diving circuit connects with the output end of the eleventh controllable transistor of the first driving circuit.

4. The scanning driving circuit as claimed in claim 2, wherein each of the first driving circuit and the second diving circuit comprises a turn-off unit, the turn-off unit comprises the twelveth controllable transistor and a thirteenth controllable transistor, control ends of the twelveth controllable transistor and the thirteenth controllable transistor are connected and connect to the output of the pull-up controlling module, an input end of the twelveth controllable transistor connects with the control end of the fourth controllable transistor, an output end of the twelveth controllable transistor connects with the reference voltage end, an input end of the thirteenth controllable transistor connects with the control end of the ninth controllable transistor, and an output end of the thirteenth controllable transistor connects with the reference voltage end.

5. The scanning driving circuit as claimed in claim 1, wherein the pull-up controlling module of the first driving circuit and the second diving circuit comprises a fourteenth controllable transistor, a control end of the fourteenth controllable transistor connects with the downstream signals at upper level, an input end of the fourteenth controllable transistor connects the scanning signals at upper level, an output end of the fourteenth controllable transistor is the output end of the pull-up controlling module; and the pull-up module of each of the first driving circuit and the second diving circuit comprises a fifteenth controllable transistor, a control end of the fifteenth controllable transistor connects with the output end of the fourteenth controllable transistor, an input end of the fifteenth controllable transistor connects with the first clock scanning signals, an output end of the fifteenth controllable transistor connects with the scanning lines.

6. The scanning driving circuit as claimed in claim 5, wherein each of the first driving circuit and the second diving circuit further comprises a downstream module having a sixteenth controllable transistor, a control end of the sixteenth controllable transistor connects with the output end of the pull-up controlling module, an input end of the sixteenth controllable transistor connects with the clock scanning signals, and an output end of the sixteenth controllable transistor connects with the downstream signals at upper level.

7. The scanning driving circuit as claimed in claim 1, wherein each of the first driving circuit and the second diving circuit comprises a pull-down module having a seventeenth controllable transistor and an eighteenth controllable transistor, control ends of the seventeenth controllable transistor and the eighteenth controllable transistor are connected and connect to the scanning lines at upper level, an input end of the eighteenth controllable transistor connects with the output end of the pull-up controlling module, output ends of the seventeenth controllable transistor and the eighteenth controllable transistor connects with the reference voltage end, and an input end of the seventeenth controllable transistor connects with the scanning lines.

8. The scanning driving circuit as claimed in claim 1, wherein each of the first driving circuit and the second diving circuit comprises a storage capacitor, one end of the storage capacitor connects with the output end of the pull-up controlling module, and the other end of the storage capacitor connects to the scanning lines.

9. The scanning driving circuit as claimed in claim 1, wherein each of the first driving circuit and the second diving circuit further comprises the pull-down module, the pull-down module comprises the seventeenth controllable transistor and the eighteenth controllable transistor, a control end of the seventeenth controllable transistor connects to the scanning lines at upper level or to the downstream signals at upper level, a control end of the eighteenth controllable transistor connects to the scanning lines at upper level or to the downstream signals at upper level, an input end of the eighteenth controllable transistor connects to the output end of the pull-up controlling module, output ends of the seventeenth controllable transistor and the eighteenth controllable transistor connect to the reference voltage end, an input end of the seventeenth controllable transistor connects to the scanning lines.

10. A liquid crystal device (LCD), comprising:

a scanning driving circuit comprising a plurality of first driving circuits and a plurality of second diving circuits, each of the first driving circuits connects with each of the second diving circuits, and the first driving circuit and the second diving circuit are alternately arranged and are connected to scanning lines;

each of the first driving circuit and second diving circuit comprises a pull-up module, a pull-up controlling module for driving the pull-up module, a reference voltage end, and a first pull-down maintaining unit, each of the first driving circuit also comprises a first pull-down maintaining controlling unit;

each of the first pull-down maintaining unit comprises a first controllable transistor and a second controllable transistor, control ends of the second controllable transistor and the first controllable transistor are connected, an input end of the second controllable transistor connects with an output end of the pull-up controlling module, output ends of the second controllable transistor and the first controllable transistor connect with the reference voltage end, an input end of the first controllable transistor connects with one scanning line;

the first pull-down maintaining controlling unit comprises a third controllable transistor, a fourth controllable transistor, and a fifth controllable transistor, an input end and a control end of the third controllable transistor connect to a first pull-down maintaining signals, a control end of the fourth controllable transistor connects to the output end of the third controllable transistor, an input end of the fourth controllable transistor connects to the first pull-down maintaining signals, an output end of the fourth controllable transistor connects to the control end of the first controllable transistor, a control end of the fifth controllable transistor connects to a second pull-down maintaining signals, an input end of the fifth controllable transistor connects to the first pull-down maintaining signals, an output end of the fifth controllable transistor connects to the control end of the first controllable transistor, a logic of the first pull-down maintaining signals is opposite to that of the second pull-down maintaining signals;

when the scanning lines are not within an operating period, the first pull-down maintaining controlling unit of the first driving circuit connects the first controllable transistor and the second controllable transistor of the first pull-down maintaining units of the first driving circuit and the second diving circuit in accordance with the first pull-down maintaining signals and the second pull-down maintaining signals, the first controllable transistor connects the scanning line with the reference voltage end, the second controllable transistor connects the pull-up controlling module with the reference voltage end; and when the scanning lines are within the operating period, the first controllable transistor and the second controllable transistor are disconnected, the first controllable transistor and the reference voltage end are disconnected, the second controllable transistor disconnects the pull-up controlling module and the reference voltage end.

11. The LCD as claimed in claim 10, wherein each of the first driving circuit and the second diving circuit comprises a second pull-down maintaining unit, each of the first driving circuit comprises a second pull-down maintaining controlling unit, the second pull-down maintaining unit comprises a sixth controllable transistor and a seventh controllable transistor, control ends of the sixth controllable transistor and the seventh controllable transistor are connected, an input end of the seventh controllable transistor connects with the output end of the pull-up controlling module, output ends of the sixth controllable transistor and the seventh controllable transistor connect with the reference voltage end, and an input end of the sixth controllable transistor connects with the scanning lines;

the second pull-down maintaining controlling unit comprises an eighth controllable transistor, a ninth controllable transistor, and a tenth controllable transistor, an input end and a control end of the eighth controllable transistor connects with the second pull-down maintaining signals, a control end of the ninth controllable transistor connects to an output end of the eighth controllable transistor, an input end of the ninth controllable transistor connects to the second pull-down maintaining signals, an output end of the ninth controllable transistor connects with a control end of the sixth controllable transistor, a control end of the tenth controllable transistor connects with the first pull-down maintaining signals, an input end of the tenth controllable transistor connects with the second pull-down maintaining signals, and an output end of the tenth controllable transistor connects with the control end of the sixth controllable transistor;

when the scanning lines are not within the operating period, the second pull-down maintaining controlling unit of the first driving circuit connects the sixth controllable transistor and the seventh controllable transistor of the second pull-down maintaining unit of the first driving circuit and the second diving circuit in accordance with the first pull-down maintaining signals and the second pull-down maintaining signals, the sixth controllable transistor connects the scanning lines with the reference voltage end, and the seventh controllable transistor connects the pull-up controlling module and the reference voltage end, when the scanning lines are within the operating period, the sixth controllable transistor and the seventh controllable transistor are disconnected, the sixth controllable transistor disconnects the scanning lines and the reference voltage end, the seventh controllable transistor disconnects the pull-up controlling module and the reference voltage end.

12. The LCD as claimed in claim 11, wherein each of the first driving circuit and the second diving circuit comprises a balance bridge unit having an eleventh controllable transistor, a control end of the eleventh controllable transistor connects with the output end of the pull-up controlling module, an input end and an output end of the eleventh controllable transistor respectively connects to the control end of the sixth controllable transistor and the first controllable transistor, the input end of the eleventh controllable transistor of the second diving circuit connects with the input end of the eleventh controllable transistor of the first driving circuit, the output end of the eleventh controllable transistor of the second diving circuit connects with the output end of the eleventh controllable transistor of the first driving circuit.

13. The LCD as claimed in claim 11, wherein each of the first driving circuit and the second diving circuit comprises a turn-off unit, the turn-off unit comprises the twelveth controllable transistor and a thirteenth controllable transistor, control ends of the twelveth controllable transistor and the thirteenth controllable transistor are connected and connect to the output of the pull-up controlling module, an input end of the twelveth controllable transistor connects with a control end of the fourth controllable transistor, an output end of the twelveth controllable transistor connects with the reference voltage end, an input end of the thirteenth controllable transistor connects with a control end of the ninth controllable transistor, and an output end of the thirteenth controllable transistor connects with the reference voltage end.

14. The LCD as claimed in claim 10, wherein the pull-up controlling module of the first driving circuit and the second diving circuit comprises a fourteenth controllable transistor, a control end of the fourteenth controllable transistor connects with the downstream signals at upper level, an input end of the fourteenth controllable transistor connects the scanning signals at upper level, an output end of the fourteenth controllable transistor is the output end of the pull-up controlling module; and the pull-up module of each of the first driving circuit and the second diving circuit comprises a fifteenth controllable transistor, a control end of the fifteenth controllable transistor connects with the output end of the fourteenth controllable transistor, an input end of the fifteenth controllable transistor connects with the first clock scanning signals, and an output end of the fifteenth controllable transistor connects with the scanning lines.

15. The LCD as claimed in claim 14, wherein each of the first driving circuit and the second diving circuit further comprises a downstream module having a sixteenth controllable transistor, a control end of the sixteenth controllable transistor connects with the output end of the pull-up controlling module, an input end of the sixteenth controllable transistor connects with the clock scanning signals, and an output end of the sixteenth controllable transistor connects with the downstream signals at upper level.

16. The LCD as claimed in claim 10, wherein each of the first driving circuit and the second diving circuit comprises a pull-down module having a seventeenth controllable transistor and an eighteenth controllable transistor, control ends of the seventeenth controllable transistor and the eighteenth controllable transistor are connected and connect to the scanning lines at upper level, an input end of the eighteenth controllable transistor connects with the output end of the pull-up controlling module, output ends of the seventeenth controllable transistor and the eighteenth controllable transistor connect with the reference voltage end, and an input end of the seventeenth controllable transistor connects with the scanning lines.

17. The LCD as claimed in claim 10, wherein each of the first driving circuit and the second diving circuit comprises a storage capacitor, one end of the storage capacitor connects with the output end of the pull-up controlling module, and the other end of the storage capacitor connects to the scanning lines.

18. The LCD as claimed in claim 10, wherein each of the first driving circuit and the second diving circuit further comprises the pull-down module, the pull-down module comprises the seventeenth controllable transistor and the eighteenth controllable transistor, a control end of the seventeenth controllable transistor connects to the scanning lines at upper level or to the downstream signals at upper level, a control end of the eighteenth controllable transistor connects to the scanning lines at upper level or to the downstream signals at upper level, an input end of the eighteenth controllable transistor connects to the output end of the pull-up controlling module, output ends of the seventeenth controllable transistor and the eighteenth controllable transistor connect to the reference voltage end, and an input end of the seventeenth controllable transistor connects to the scanning lines.

19. A scanning driving circuit, comprising:

a plurality of first driving circuits and a plurality of second diving circuits, each of the first driving circuits connects with each of the second diving circuits, and the first driving circuit and the second diving circuit are alternately arranged and are connected to scanning lines;

each of the first driving circuit and second diving circuit comprises a pull-up module, a pull-up controlling module for driving the pull-up module, a reference voltage end, and a first pull-down maintaining unit, each of the first driving circuit also comprises a first pull-down maintaining controlling unit;

wherein the pull-up controlling module comprises a fourteenth controllable transistor, a control end of the fourteenth controllable transistor connects with the downstream signals at upper level, an input end of the fourteenth controllable transistor connects the scanning signals at upper level, and an output end of the fourteenth controllable transistor is the output end of the pull-up controlling module;

the pull-up module comprises a fifteenth controllable transistor, a control end of the fifteenth controllable transistor connects with the output end of the fourteenth controllable transistor, an input end of the fifteenth controllable transistor connects with the first clock scanning signals, and an output end of the fifteenth controllable transistor connects with the scanning lines;

each of the first driving circuit and the second diving circuit comprises a storage capacitor, one end of the storage capacitor connects with the output end of the pull-up controlling module, and the other end of the storage capacitor connects to the scanning lines;

each of the first pull-down maintaining unit comprises a first controllable transistor and a second controllable transistor, control ends of the second controllable transistor and the first controllable transistor are connected, an input end of the second controllable transistor connects with the output end of the pull-up controlling module, output ends of the second controllable transistor and the first controllable transistor connect with the reference voltage end, and an input end of the first controllable transistor connects with one scanning line;

the first pull-down maintaining controlling unit comprises a third controllable transistor, a fourth controllable transistor, and a fifth controllable transistor, an input end and a control end of the third controllable transistor connect to a first pull-down maintaining signals, a control end of the fourth controllable transistor connects to the output end of the third controllable transistor, an input end of the fourth controllable transistor connects to the first pull-down maintaining signals, an output end of the fourth controllable transistor connects to the control end of the first controllable transistor, a control end of the fifth controllable transistor connects to a second pull-down maintaining signals, an input end of the fifth controllable transistor connects to the first pull-down maintaining signals, an output end of the fifth controllable transistor connects to the control end of the first controllable transistor, a logic of the first pull-down maintaining signals is opposite to that of the second pull-down maintaining signals;

when the scanning lines are not within an operating period, the first pull-down maintaining controlling unit of the first driving circuit connects the first controllable transistor and the second controllable transistor of the first pull-down maintaining units of the first driving circuit and the second diving circuit in accordance with the first pull-down maintaining signals and the second pull-down maintaining signals, the first controllable transistor connects the scanning line with the reference voltage end, the second controllable transistor connects the pull-up controlling module with the reference voltage end; and when the scanning lines are within the operating period, the first controllable transistor and the second controllable transistor are disconnected, the first controllable transistor and the reference voltage end are disconnected, the second controllable transistor disconnects the pull-up controlling module and the reference voltage end.

20. The scanning driving circuit as claimed in claim 19, wherein each of the first driving circuit and the second diving circuit comprises a second pull-down maintaining unit, each of the first driving circuit comprises a second pull-down maintaining controlling unit, the second pull-down maintaining unit comprises a sixth controllable transistor and a seventh controllable transistor, control ends of the sixth controllable transistor and the seventh controllable transistor are connected, an input end of the seventh controllable transistor connects with the output end of the pull-up controlling module, output ends of the sixth controllable transistor and the seventh controllable transistor connect with the reference voltage end, and an input end of the sixth controllable transistor connects with the scanning lines;

the second pull-down maintaining controlling unit comprises an eighth controllable transistor, a ninth controllable transistor, and a tenth controllable transistor, a input end and a control end of the eighth controllable transistor connects with the second pull-down maintaining signals, a control end of the ninth controllable transistor connects to the output end of the eighth controllable transistor, an input end of the ninth controllable transistor connects to the second pull-down maintaining signals, an output end of the ninth controllable transistor connects with the control end of the sixth controllable transistor, a control end of the tenth controllable transistor connects with the first pull-down maintaining signals, an input end of the tenth controllable transistor connects with the second pull-down maintaining signals, and an output end of the tenth controllable transistor connects with the control end of the sixth controllable transistor;

when the scanning lines are not within the operating period, the second pull-down maintaining controlling unit of the first driving circuit connects the sixth controllable transistor and the seventh controllable transistor of the second pull-down maintaining unit of the first driving circuit and the second diving circuit in accordance with the first pull-down maintaining signals and the second pull-down maintaining signals, the sixth controllable transistor connects the scanning lines with the reference voltage end, and the seventh controllable transistor connects the pull-up controlling module and the reference voltage end, when the scanning lines are within the operating period, the sixth controllable transistor and the seventh controllable transistor are disconnected, the sixth controllable transistor disconnects the scanning lines and the reference voltage end, the seventh controllable transistor disconnects the pull-up controlling module and the reference voltage end.

* * * * *